US006543350B2

(12) United States Patent
Gilliam et al.

(10) Patent No.: US 6,543,350 B2
(45) **Date of Patent: *Apr. 8, 2003**

(54) MEASUREMENT SYSTEM TO MONITOR PRINTING CONTACT PRESSURE

(75) Inventors: Ronald D. Gilliam, Grafton, OH (US); Paul C. Skala, Stow, OH (US)

(73) Assignee: Intelligent Sensing, Inc., Oberlin, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/573,952

(22) Filed: May 19, 2000

(65) Prior Publication Data

US 2002/0189469 A1 Dec. 19, 2002

(51) Int. Cl.[7] ..... B41F 17/06

(52) U.S. Cl. ..... 101/213; 101/213; 101/216; 101/484; 101/247

(58) Field of Search ..... 101/213, 212, 101/477, 266, 267, 484, 152, 153, 216, 217, 218, 283, 284, 483, 247

(56) References Cited

U.S. PATENT DOCUMENTS

| | | | | | |
|---|---|---|---|---|---|
| 3,894,488 | A | * | 7/1975 | Gazzola et al. | 101/153 |
| 5,181,257 | A | * | 1/1993 | Steiner et al. | 382/17 |
| 5,181,468 | A | * | 1/1993 | Borel | 101/216 |
| 5,448,949 | A | * | 9/1995 | Bucher | 56/367 |
| 5,740,736 | A | * | 4/1998 | Toyoda | 101/218 |
| 5,774,225 | A | * | 6/1998 | Goldstein et al. | 356/402 |
| 5,794,531 | A | * | 8/1998 | Keller | 101/479 |
| 5,865,120 | A | * | 2/1999 | Gross | 101/482 |
| 5,904,093 | A | * | 5/1999 | Pollock | 70/278.2 |
| 5,970,870 | A | * | 10/1999 | Shiba et al. | 101/137 |
| 6,041,706 | A | * | 3/2000 | Murray | 101/217 |
| 6,272,987 | B1 | * | 8/2001 | Kamoda | 101/153 |

* cited by examiner

*Primary Examiner*—Andrew H. Hirshfeld
*Assistant Examiner*—Darius N. Cone
(74) *Attorney, Agent, or Firm*—John F. McDevitt

(57) ABSTRACT

A measurement system is disclosed enabling the operator of a rotary printing press to continuously discern the contact pressure being exerted during the printing of a visual image. The measurement system requires the pressure sensing components being employed to cooperate with further sensing components detecting angular position of the printing plates when the pressure measurements are being carried out to produce a continuous visual display for the press operator.

23 Claims, 2 Drawing Sheets

MEASUREMENT SYSTEM TO MONITOR PRINTING CONTACT PRESSURE

BACKGROUND OF THE INVENTION

This invention relates generally to a method and apparatus for monitoring the contact pressure being exerted when the printed image is being formed in a rotary printing press and more particularly to providing novel means to do so during press operation for any corrective action needed.

The contact pressure being exerted between rotating printing plates during operation of a rotary printing press, such as an offset printing press, a lithograph printing press and the like, is well recognized to undergo significant variation reducing the quality of the printed image. For example, too little contact pressure results in a printed image being faint or missing details and which can require the press operator to adjust the contact pressure during further press operation for avoidance of additional spoilage. Such corrective action taken by the press operator can understandably be carried out long after needed thereby causing considerable loss of the various objects on which the printed image is applied, such as metal cans, plastic containers and the like. In a similar manner, the application of excessive contact pressure when the printed image is being applied causes the liquid link to smear upon deposition and thereby require the press operator to make the necessary adjustments for reducing the amount of this operating factor during continued press operation. Such variation in contact pressure between the printing plates during operation of a rotary printing press can also be caused by a wide variety of operating conditions, including temperature changes, rotational speeds of operation, materials employed to produce the printed image and still other operating factors. A commonly experienced temperature change affecting contact pressure between the rotating printing plates occurs during press start-up after customary periods of press inactivity which causes critical printing surfaces to physical contract due to experiencing lower temperatures while being inactive. It remains desirable, therefore, to provide improved means whereby the printing contact pressure in a rotary printing press can be more effectively monitored during press operation.

Various methods and apparatus are already known to adjust the contact pressure between printing plate members of a rotary printing press. For example, there is disclosed in U.S. Pat. No. 5,181,468 a device to control the operating contact pressure between printing plate rollers of an offset printing press which includes employment of a pneumatic jack device to do so. The press operator is able to vary the operating pressure with such device during press operation. In U.S. Pat. No. 5,622,114 there is disclosed a method for adjusting contact between the printing plate rollers of a rotary printing press which first includes separating the rollers while stationary to permit a piezofilm to be inserted therebetween for generation of an output signal being transmitted to an optical image display device. In a different embodiment, a pneumatic device is employed for adjustment which can further include pressure sensor means connected to said optical display. Both methods are said to be useful "as a partial solution" in enabling automated roller adjustment. An apparatus for such automated roller adjustment in a rotary printing press is also disclosed in U.S. Pat. No. 5,275,099. In doing so, the contact pressure between the rotating plate roller and a form roller physically abutting the rotating plate roller is detected with multiple strain gage sensors mounted on a mechanical pivoting arm. Correcting the contact pressure during press operation to a predetermined value is said to be achieved automatically with a feedback type servomechanism employing comparator means.

To overcome the aforesaid operational difficulties with such type rotary printing press, there is now provided a novel measurement system for monitoring the contact pressure between the printing plate rollers of a rotary printing press while being operated in a further improved manner. In the operation of the present measurement system, a continuous visual display of the dynamic variations occurring in the printing contact pressure during formation of the printed images enables the press operator to make more immediate corrections for any variations displayed beyond the control limits established for an acceptable printed image. In doing so, a display is first recorded on a visual screen, such as a PC monitor or other like device, for both customary upper and lower form roller contact pressure values so recorded when the particular printed image being formed is found acceptable to establish an envelope on the screen during continued press operation with respect to said printed image. A continuing display of said dynamic contact pressure values thereafter immediately notifies the press operator when any manual adjustment of the contact pressure controls is required to maintain said values within the previously recorded envelope appearing on the display screen. Providing a suitable continuous visual display in said manner can be carried out by sensing when a first printing plate disposed on the outer surface of a rotating plate roller of a rotary printing press comes into registration with a second printing plate disposed on the outer surface of a rotating blanket roller in said printing press, concurrently measuring the contact pressure being exerted between the customary pair of rotating form or inking rollers physically abutting the rotating plate roller during the time period when the printing plates on the plate roller and blanket roller remain in registration, further sensing the angular position of the rotating form rollers during the time period when the printing plates on the plate and blanket rollers remain in registration and continuously displaying the variation in contact pressure with respect to angular position of the rotating form rollers. A continuous monitoring of dynamic contact pressure values in this manner can understandably improve the operating efficiency of various type rotary printing presses to include those having single and multiple printing heads as well as those producing single and multicolored printed images.

It is an object of the present invention, therefore, to provide a monitoring system for operation of a rotary printing press to improve the visual quality of the printed image.

It is another object of the present invention to provide said presently improved monitoring system in a manner requiring only a relatively simple modification to the existing rotary printing press apparatus.

A still further object of the present invention is to provide a rotary printing press incorporating the presently improved monitoring system for increased operating efficiency.

It is yet another object of the present invention to provide a novel method for continuously monitoring the resulting quality of a printed image while being formed in a rotary printing press.

These and still further objects of the present invention will become apparent upon considering the following detailed description of the present invention.

SUMMARY OF THE INVENTION

It has now been discovered by the present applicant that a continuous visual monitoring system when carried out in a particularly defined manner can significantly improve the operating efficiency of a rotary printing press. Generally, the presently improved method for monitoring contact pressure between rotating printing plate members in said apparatus requires continuously sensing when a first printing plate disposed on the outer surface of a rotating plate roller in said printing press comes into registration with a second printing plate disposed on the outer surface of a rotating blanket roller in said printing press, concurrently measuring the contact pressure being exerted between a pair of rotating form rollers physically abutting the rotating plate roller during the time period when the printing plates on the plate roller and blanket roller remain in registration, further sensing the angular position of the rotating form rollers during the time period when the printing plates on the plate and blanket rollers remain in registration, and continuously displaying on a visual screen the variation in contact pressure with respect to angular position of the rotating form rollers that occurs during said time periods. In one embodiment wherein the contact pressure is monitored with a strain gage disposed at each end of both form rollers, it now becomes possible for the press operator to correct for variations occurring beyond previously established upper and lower limits being displayed on the visual screen with a greater degree of control. More particularly, multiple displays on the same visual screen can be employed enabling the press operator to continuously observe pressure fluctuations occurring over major areas of the printing surface such as horizontal as well as vertical and diagonal contact pressure variation.

A representative measurement system in accordance with the present invention comprises position sensing means to detect when a first printing plate disposed on the outer surface of a rotating plate roller in the rotary printing press comes into registration with a second printing plate disposed on the outer surface of a rotating blanket roller in the printing press, pressure sensing means to measure the contact pressure being exerted between a pair of form rollers physically abutting the rotating plate roller, rotational feedback means determining the angular position of the rotating form rollers during the time period when the printing plates on the plate and blanket rollers remain in registration, and visual display means continuously depicting the variation in contact pressure with respect to angular position of the rotating form rollers. In said embodiment, individual position sensing elements can be physically connected to the respective plate and blanket rollers in the conventional manner with a further operatively cooperating conventional encoder or resolver device being physically connected to the supporting shaft for the blanket roller. To increase the sensitivity of the contact pressure measurements being displayed in the present embodiment, an otherwise conventional strain gage device can be employed for attachment to each form roller in a further required manner. The multiple strain gage devices being employed for mounting on opposing ends of the central shaft supporting each form roller are affixed to the customary pivoting mechanical arm connected to each form roller and with each of said mechanical arms having been modified to include discontinuities or air gaps enabling greater flexure of the strain gage affixed thereto.

Incorporating the above illustrated monitoring system into an otherwise conventional rotary printing press of many types can be carried out in a routine manner. There is only further required well known analog and digital data processors, such as the Sigmeter data analyzer being sold by Sciemetric Company, Canada and still others having additional channel response for connection to the individual sensing devices being employed. The illustrated Sigmeter device acquires the strain gage voltages from both form rollers for conversion to a digital value. The changing digital values are then referenced in said device to the input encoder pulses being received for display as the ordinate of a conventional binary graph. The angular position values derived from the encoder or resolver device are also presented to the operationally connected visual display for the abscissa portion of said graph. In this manner, the envelope created with the upper form rollers forms one continuous display on said screen while the envelope for the lower form rollers is simultaneously displayed as a second envelope on said screen.

DETAILED DESCRIPTION OF THE PREFERRED EMBODIMENTS

Figure 1:
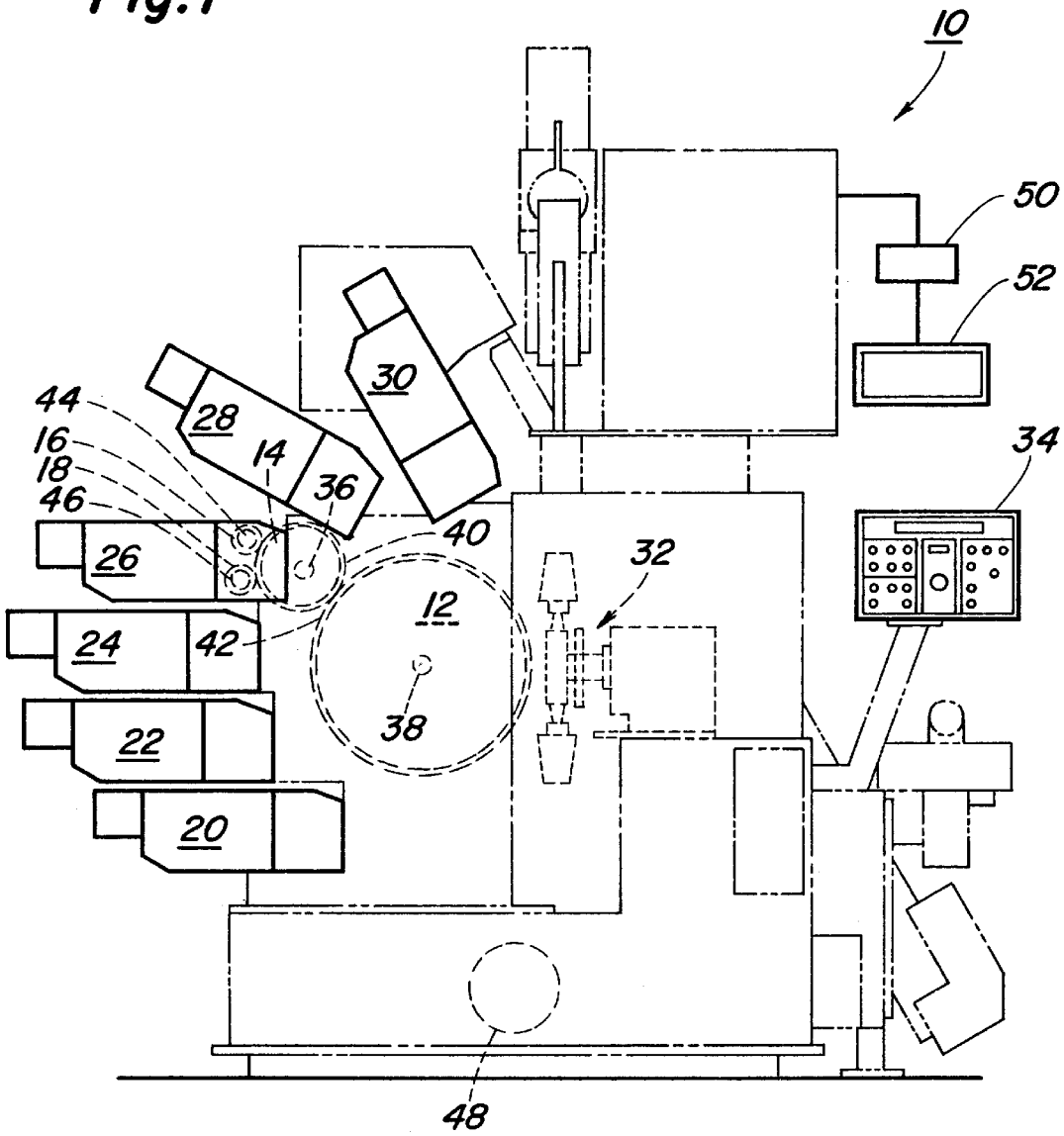
FIG. 1 is a schematic side view for a representative multiple printing head rotary printing press according to the present invention.

Referring to the drawings, there is shown in FIG. 1 a schematic side view of a conventional offset printing press which incorporates a representative monitoring system of the present invention. Basically, the printing press 10 includes blanket roller 12, plate roller 14, a pair of upper and lower form rollers 16 and 18, respectively, physically engaging the plate roller 14, multiple printing heads 20–30, a rotating turret-type feed mechanism 32 for the product articles (not shown) on which a multi-colored printed image is applied, and a control panel 34 enabling the press operator to adjust the printing contact pressure being exerted during printing. The further depicted components of the illustrated monitoring system which enables said press operator to continuously discern the contact printing pressure being exerted to form such multi-colored printed image comprise conventional proximity or position sensors 36 and 38 physically connected to both plate and blanket rollers, respectively, to determine when a pair of printing plates 40 and 42 physically disposed on the peripheral surface of the latter members come into registration, strain gages 44 and 46 operationally connected to form rollers 16 and 18, encoder device 48 determining the angular position of said form rollers when the printing plates remain in registration, a conventional digital data processor 50 receiving output electrical signals from both strain gages 44 and 46 for operative cooperation with further output electrical signals from encoder device 48, and a conventional visual screen device 52 displaying the combined processor signals continuously in the form of a binary arithmetic graph envelope (not shown). In this manner, the proximity sensor for the plate roller detects the leading edge of a first printing plate disposed thereon. When the proximity sensor for the blanket roller indicates that a second printing plate disposed thereon rotates into registration with said first printing plate then measurement of the contact printing pressure being exerted between said printing plates is initiated for recording on the visual screen in response to the cooperating encoder pulses. The data processor being employed converts the strain gage voltages being measured to digital values for presentation on the visual screen as the Y coordinate. The positional values provided with said encoder pulses form the X coordinate also being continuously recorded on the visual screen. Suitable proximity or position sensor devices for use in the illustrated monitoring system include Model PMF44, manufactured by Sunx, West DesMoines, Iowa and Model OG5054, manufactured by Effector, Exton, Pa. A suitable encoder device for the illustrated monitoring system is Model 755A, manufactured by Encoder Products, Sand Point, Id. but comparable results are also believed achievable with conventional analog shaft resolver devices. It can be further noted with respect to the illustrated monitoring system that having strain gages being connected to both upper and lower form rollers enables simultaneous graphical representation in the same manner for each roller's performance.

Figure 2:
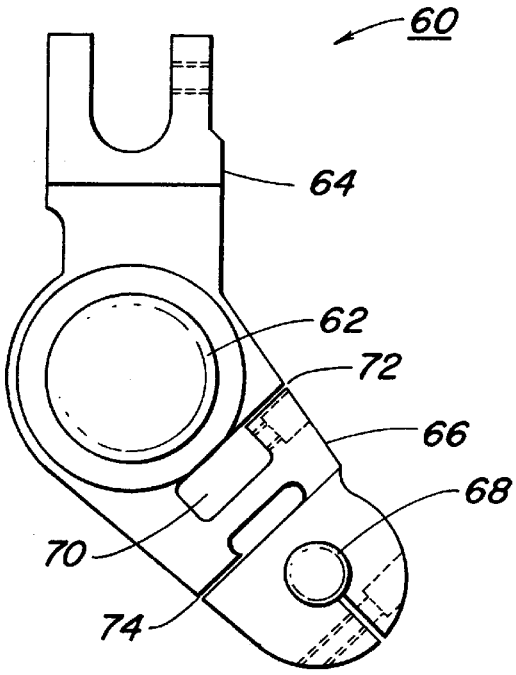
FIG. 2 is a side view depicting physical mounting of a strain gage sensor in the FIG. 1 rotary printing press.

FIG. 2 is a side view depicting one of the pivoting mechanical arms 60 to which individual strain gages in the FIG. 1 monitoring system are physically secured. Each of said L shaped mechanical arms pivots about a shaft 62 with end portion 64 being fixed to the press frame (not shown) whereas free end portion 66 is attached to the shaft 68 on which each frame roller (16 and 18) rotates. Accordingly, said multiple mechanical arms are individually disposed at opposite ends of both upper and lower form rollers in the presently illustrated monitoring system thereby enabling the printing contact pressure to be continuously monitored over much of the printing surface. As can be further noted in the present drawing, free end portion 66 of said pivoting mechanical arm includes a cavity 70 in which an individual strain gage (44 or 46) resides with air gaps or discontinuities 72 and 74 having been formed on each side of said cavity to increase the sensitivity of the continuous printing contact pressure measurements being monitored. Understandably, a monitoring of printing contact pressure in the described manner further serves to improve printing quality in all major spatial directions.

Figure 3:
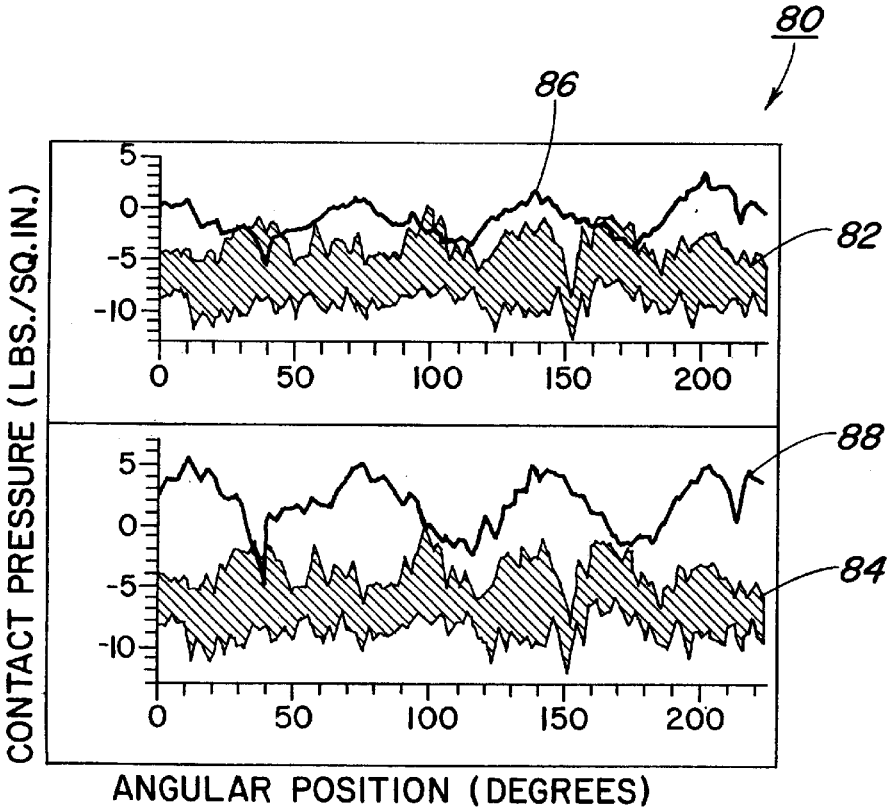
FIG. 3 is a binary graph for representative measurements being displayed continuously during operation of the FIG. 1 press.

There is depicted in FIG. 3 a visual representation of the continuous contact pressure measurements being recorded in the FIG. 1 monitoring system. A conventional display screen 80 is employed, such as a PC monitor or other like device, for electrical connection to the previously disclosed digital data processor unit (50) also being used to provide these measurements in the present embodiment. There is first recorded on said visual screen a pair of shaded envelopes 82 and 84 representing an acceptable range of printing contact pressure values when a particular printed image has been formed having satisfactory print quality. Envelope 82 represent pressure measurements formed with upper form roller 16 while envelope 84 represents like measurements made with lower form roller 18. As can be observed in the present drawing, ordinate values for said envelopes are recorded in pounds per square inch of printing pressure whereas the abscissa values represent angular position of the form rollers commencing when said pressure measurements are initiated. In this manner the pressure measurements from both upper and lower form rollers are visually presented to the press operator indicating any need for adjustment of continuous contact pressures being exerted to maintain acceptable print quality. There is also depicted on said visual screen illustrative printing contact pressure measurements varying outside the acceptable envelope values for both upper and lower form rollers. Thus, curve 86 for the upper form roller measurements provides immediate visual notice to said press operator that adjustment in the contact printing pressure being exerted by the upper form rollers is needed to bring said curve within the already displayed limits of envelope 82. Likewise, curve 88 for the lower form roller measurement which resides outside envelope 84 signifies to the press operator that adjustment of the lower form rollers is needed for acceptable print quality.

It will be apparent from the foregoing description that a broadly useful and novel means has been provided to continuously monitor the contact pressure being exerted when the printed image is being formed in a rotary printing press. It is contemplated that various modifications can be made in the present method for monitoring print quality as well as for the apparatus being employed to do so other than herein specifically illustrated, however, without departing from the spirit and scope of the present invention. For example, other position sensors denoting proper registration between the plate and blanket rollers can be employed as well as substituting other pressure sensing devices than strain gages. Similarly, other digital and analog data processors are contemplated with more channel capacity than the two-channel processor herein illustrated for even more extensive monitoring of printing contact pressure leading to still further improved print quality. Accordingly, it is intended to limit the present only by the scope of the appended claims.

What we claim as new and desire to secure by Letters Patent of the United States is:

1. A method to monitor contact pressure between pairs of rotating printing plates disposed on the outer surface of rotating plate and blanket rollers in an offset type rotary printing press further including a pair of rotating upper and lower form rollers which transfer printing ink to said plate roller which comprises:

(a) continuously sensing during press operation with said upper and lower form rollers when a first printing plate disposed on the outer surface of said rotating plate roller in said printing press comes into registration with a second printing plate disposed on the outer surface of said rotating blanket roller in said printing press, (b) concurrently and continuously measuring the contact pressure being exerted between said pair of rotating form rollers physically abutting the rotating plate roller during the time period when the printing plates on the plate roller and the blanket roller remain in registration, said contact pressure being measured with mechanical pressure sensing devices which are disposed adjacent opposite ends of both upper and lower form rollers, (c) further sensing the angular position of said rotating form rollers during the time period when said printing plates on the plate and blanket rollers remain in registration, and (d) continuously displaying a graphical visual image of the variation in contact pressure with respect to the angular position of said rotating form rollers during said time period, and said graphical visual image being displayed is a conventional binary graph.

2. The method of claim 1 wherein measuring the contact pressure in step (b) is conducted with a strain gage disposed at each end of both form rollers.

3. The method of claim 2 wherein the strain gage is physically mounted on a mechanical arm physically connected to the form rollers.

4. The method of claim 1 wherein registration between the printing plates on the plate and blanket roller is detected with individual sensor elements.

5. The method of claim 4 wherein the sensor elements detect the leading edge of the printing plates disposed on the outer surfaces of both rotating plate and blanket rollers.

6. The method of claim 1 wherein angular position of said rotating form rollers is detected with a rotational feedback device.

7. The method of claim 1 wherein the contact pressure measurements are initiated with operationally cooperating pulses from the rotational feedback device.

8. The method of claim 7 wherein the pulses are generated by an encoder device connected to the rotating blanket roller.

9. A method to monitor contact pressure between pairs of rotating printing plate members disposed on the outer surface of rotating plate and blanket rollers in an offset type rotary printing press employing multiple printing heads each applying a single color forming part of a printed image to a first printing plate disposed on the outer surface of said rotating plate roller and further including a pair of rotating upper and lower form rollers which transfer printing ink to said plate roller which comprises:

(a) continuously sensing during press operation with said upper and lower form rollers when a first printing plate disposed on the outer surface of said rotating plate member in said printing press comes into registration with a second printing plate disposed on the outer surface of said rotating blanket roller in said printing press, (b) concurrently and continuously measuring the contact pressure being exerted between said pair of rotating form rollers physically abutting the rotating plate roller during the time period when the printing plates on the plate roller and the blanket roller remain in registration, said contact pressure being measured with mechanical pressure sensing devices which are disposed adjacent opposite ends of both upper and lower form rollers, (c) further sensing the angular position of said rotating form rollers during the time period when said printing plates on the plate and blanket rollers remain in registration, and (d) continuously displaying the variation in contact pressure as a graphical image with respect to angular position of said rotating form rollers during said time period, and said graphical visual image being displayed as a conventional binary graph.

10. The method of claim 9 wherein the printed image formed in said manner has multiple colors.

11. The method of claim 10 wherein the multiple colors are all applied during a single rotation of the blanket roller.

12. The method of claim 11 wherein each color is applied at a different angular position of the blanket roller.

13. A measurement system to monitor during press operation the contact pressure between pairs of rotating printing plate members disposed on the outer surface of rotating plate and blanket rollers in an offset type rotary printing press further including a pair of rotating upper and lower form rollers which transfer printing ink to said plate roller which comprises:

(a) position sensing means to continuously detect during press operation when a first printing plate disposed on the outer surface of said rotating plate roller in said printing press comes into registration with a second printing plate disposed on the outer surface of said rotating blanket roller in said printing press, (b) mechanical pressure sensing devices which are disposed at opposite ends of both upper and lower form rollers to measure the contact pressure being exerted by said pair of form rollers physically abutting the rotating plate roller, (c) rotational feedback means determining the angular position of said rotating form rollers during the time period when the printing plates on said plate and blanket rollers remain in registration, and (d) visual display means depicting the variation in contact pressure as a graphical visual image with respect to angular position of said rotating form rollers while said printing plates on the plate and blanket rollers remain in registration, and said graphical visual image being displayed as a conventional binary graph.

14. The measurement system of claim 13 wherein the pressure sensing means includes a strain gage.

15. The measurement system of claim 14 wherein the pressure sensing means employs a strain gage disposed at each end of both form rollers.

16. The measurement system of claim 13 wherein registration between the printing plates on the plate and blanket rollers is detected with individual sensing elements.

17. The measurement system of claim 13 wherein the rotational feedback means are physically connected to the rotating blanket roller.

18. The measurement system of claim 13 wherein the rotary printing press employs multiple printing heads each applying a single color forming part of the printed image.

19. An offset type rotary printing press having a measurement system to continuously monitor the contact pressure employed in forming a printed image during press operation, the printing press including pairs of rotating printing plate members disposed on the outer surface of rotating plate and blanket rollers together with a pair of rotating upper and lower form rollers which transfer printing ink to said plate roller, said measurement system comprising:

(a) position sensing means to continuously detect during press operation when a first printing plate disposed on the outer surface of said rotating plate roller in said printing press comes into registration with a second printing plate disposed on the outer surface of said rotating blanket roller in said printing press, (b) mechanical pressure sensing devices which are disposed at opposite ends of both upper and lower form rollers to measure the contact pressure being exerted by said pair of form rollers physically abutting the rotating plate roller, (c) rotational feedback means determining the angular position of said rotating form rollers during the time period when the printing plates on said plate and blanket rollers remain in registration, and (d) visual display means depicting the variation in contact pressure as a graphical visual image with respect to angular position of said rotating from rollers while said printing plates on the plate and blanket rollers remain in registration, and said graphical visual image being displayed as a conventional binary graph.

20. The rotary printing press of claim 19 wherein the pressure sensing means includes a strain gage.

21. The rotary printing press of claim 20 wherein the pressure sensing means employs a strain gage disposed at each end of both form rollers.

22. The rotary printing press of claim 19 wherein registration between the printing plates on the plate and blanket rollers is detected with individual sensing elements.

23. The rotary printing press of claim 19 which employs multiple printing heads each applying a single color forming part of the printed image.

* * * * *